US005169067A

United States Patent [19]

Matsusaka et al.

[11] Patent Number: 5,169,067

[45] Date of Patent: Dec. 8, 1992

[54] ELECTROMAGNETICALLY OPERATED ULTRASONIC FUEL INJECTION DEVICE

[75] Inventors: Masanobu Matsusaka, Toyota; Hirotsugu Sugiura, Hekinan; Motonobu Akaki, Anjo, all of Japan

[73] Assignee: Aisin Seiki Kabushiki Kaisha, Kariya, Japan

[21] Appl. No.: 736,211

[22] Filed: Jul. 26, 1991

[30] Foreign Application Priority Data

Jul. 30, 1990 [JP] Japan ..... 2-199229

[51] Int. Cl.[5] ..... B05B 17/06

[52] U.S. Cl. ..... 239/102.2; 239/585.1

[58] Field of Search ..... 239/102.2, 585.1, 585.3

[56] References Cited

U.S. PATENT DOCUMENTS

| | | | |
|---|---|---|---|
| 4,389,999 | 6/1983 | Jaqua | 239/102.2 X |
| 4,750,706 | 6/1988 | Schlagmüller | 239/102.2 X |
| 4,974,780 | 12/1990 | Nakamura et al. | 239/102.2 |
| 5,080,079 | 1/1992 | Yoshida et al. | 235/585 X |

FOREIGN PATENT DOCUMENTS

| | | | |
|---|---|---|---|
| 0122154 | 10/1978 | Japan | 239/102.2 |
| 0005545 | 1/1982 | Japan | 239/102.2 |
| 61-283760 | 12/1986 | Japan . | |

*Primary Examiner*—Andres Kashnikow
*Assistant Examiner*—William Grant
*Attorney, Agent, or Firm*—Oblon, Spivak, McClelland, Maier & Neustadt

[57] ABSTRACT

An injection device includes a housing, a first member accommodated in the housing and having an inner space which is terminated at one side thereof in a seat, a second member having at one end thereof a head and disposed in the inner space of the nozzle member in such a manner that an axial passage is defined therebetween and the head and the seat constitute a valve, and an actuator for opening/closing the valve. A horn has an ultrasonic vibrator to vibrate the horn so that injected fuel is atomized.

6 Claims, 2 Drawing Sheets

ELECTROMAGNETICALLY OPERATED ULTRASONIC FUEL INJECTION DEVICE

BACKGROUND OF THE INVENTION

1. Field of the Invention

The present invention relates to a fuel injection device and in particular to a fuel injection device for an internal combustion engine.

2. Description of the Prior Art

A conventional fuel injection device is disclosed, for example, in Japanese Patent Laid-open Print No. Sho61-283760 published in 1986 without examination. As shown in FIG. 2, the foregoing conventional fuel injection device includes a body 31 with an injecting aperture 30 and a needle valve 32 which is formed integrally with a housing 33. When the injection is performed, the body 31 is moved against a biasing force of a spring 35 as a result of actuation of a piezoelectric actuator 34.

However, in the foregoing injection device, the movement of the injecting aperture upon injection restricts the location or position of the device.

SUMMARY OF THE INVENTION

It is, therefore, a primary object of the present invention to provide an injection device without the foregoing drawback.

It is another object of the present invention to provide an injection device in which an injecting aperture or a nozzle is not moved.

In order to attain the above and other objects, an injection device in accordance with the invention includes a housing, elongate first and second members, and a horn. The elongate first member is accommodated in the housing and defines an inner space. The first member has one end supported by the first portion of the housing and another end defining a seat. The elongate second member is fitted in the upper space and has an upper and a head end cooperating with the seat to form a valve from which liquid fuel can be injected upon opening thereof. The horn has an ultrasonic vibration generator positioned adjacent the one end of the first member and an atomizing portion extending adjacent the valve so that the injected liquid fuel is atomized. The horn is rigidly mounted to the housing at a second portion of the housing which is farther from the first portion than the vibration generator is from the first portion.

BRIEF DESCRIPTION OF THE DRAWINGS

The above and other objects, features and advantages of the present invention will be become more apparent and more readily appreciated from the following detailed description of preferred exemplary embodiments of the present invention, taken in connection with the accompanying drawings, in which.

DETAILED DESCRIPTION OF THE PREFERRED EMBODIMENT

Figure 1:
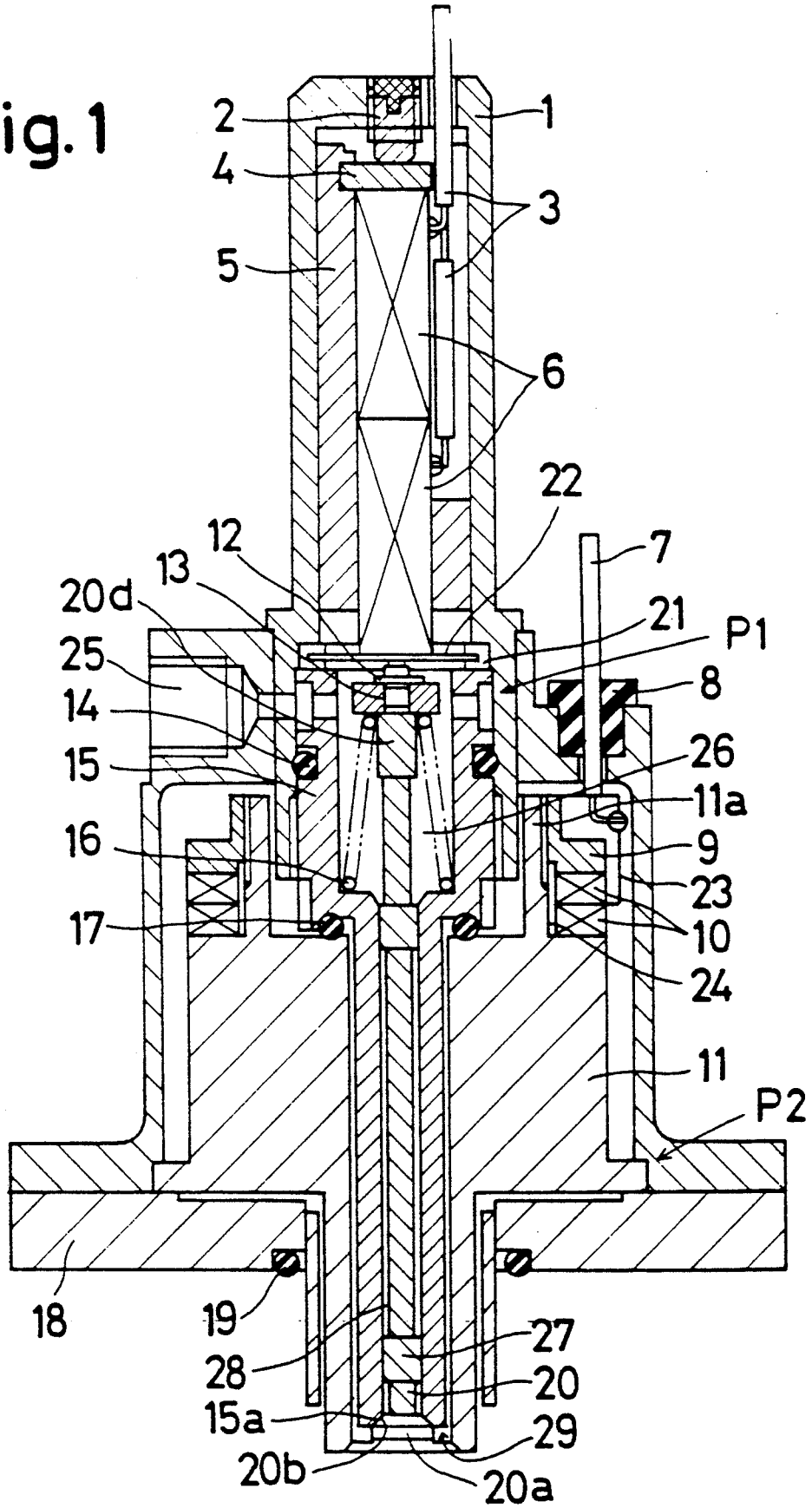
FIG. 1 is a vertical cross-sectional view of an injection device according to the present invention.
Figure 2:
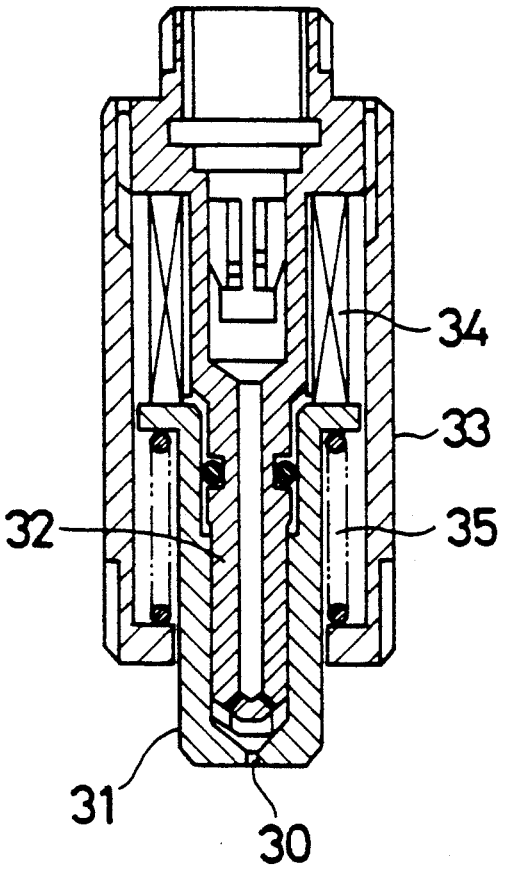
Fig. 2 (PRIOR ART)
FIG. 2 is a vertical cross-sectional view of a conventional injection device.

Referring now to FIG. 1, a first portion of a housing 1 is provided with an inlet port 25 to which an amount of liquid fuel is supplied. In the housing 1, a an elongate first member or a nozzle member 15 is accommodated. Between an inner side of the first portion P1 of housing 1 and one end of the first member 15 held thereby, there is interposed an O-ring 14 for assuring the fluid-tightness therebetween. The first member 15 is mounted on a horn 11 via an O-ring 17 and is extended through the horn 11 in the downward direction to another end. The first member 15 has an inner space whose upper portion is used for a fuel chamber 26 which is in fluid communication with the inlet port 25.

Within the inner space of the the first member 15, an elongate second member or a valve member 20 is disposed to be movable in the axial direction and an axial passage 28 is defined between both members 15 and 20. A pair of vertically spaced guide portions 27 and 27 are formed integrally with the second member 20 for assuring the smooth movement thereof. At a lower or head end of the second member 20, there is formed a head **20*a* whose inner surface 20*b* is in the form of an inverted tapered configuration. The surface 20*b* of the head 20*a* is in abutment with a seat 15*a* which is formed at a lower another end of the first member 15. The seat 15*a* is in the form of the outwardly expanded frust configuration and is set to constitute a valve 29 by cooperating with the head 20*a*. It is noted that in each guide portion 27 there is formed a means for enabling fluid communication between the fluid chamber 26 and the valve 29 through the axial passage 28**.

A retainer 13 is mounted on an enlarged portion **20*d* of the second member 20 which is at an upper end thereof and is set not to be removed from the second member 20 by an E-ring 12. Between the retainer 13 and a bottom surface of the fuel chamber 26, there is disposed a spring 16 for urging the second member 20 in the upward direction, thereby normally closing the valve 29**.

The upper end of the second member 20 is in opposition to a sealing plate or a diaphragm 22 which is set to be deformed by an amount of displacement of a pair of stacked actuators 6 and 6 upon the turning on thereof. An outer periphery of the diaphragm 22 is fluid-tightly held between the housing 1 and the first member 15. Each actuator 6 is set to be supplied with a current via a lead wire 3. An upper end of the upper-sided or upper-located actuator 6 is in abutment with a plate 4 resting on a stepped portion of a casing 5 which is urged by an adjusting screw which is threadably driven into an upper end of the housing 1. The adjusting screw 2 is set so that the valve 29 may be fully closed.

Around the first member 15 on the horn 11 is an ultrasonic generator which includes a pair of stacked piezoelectric elements 10 and 10. The piezoelectric elements 10 and 10 are arranged oppositely in polarization and between which a terminal 23 is held to be supplied with an amount of current via a lead wire 7. The piezoelectric elements 10 and 10 are held between an upper surface of the horn 11 and a holder 9 which is mounted on an upward extension **9*a* of the horn 11. The ultrasonic generator 10, the holder 9 and the horn 11 constitute the Langevin Type Transducer, which is rigidly mounted by a second portion P2 of the housing 1 and a guide member 18. The horn 11** is so located or positioned as to correspond to the node of resonance.

In operation, upon supply of the liquid fuel to the inlet port 25 under a pressure ranging from 20 to 30 kg per 1 cm square, the inner space including the fuel chamber 26 and the axial passage 28 is filled with the resultant fuel. When the actuators 6 and 6 are excited by supplying currents (100V D.C.) thereto, the downward displacement of the actuators 6 and 6 are established, by which the diaphragm 22 is deformed in the downward direction. Then, the second member 20 is pushed and is moved in the downward direction at a stroke resulting in the opening of the valve 29.

Due to the opening of the valve 15, the fuel is injected therefrom. The resultant fuel is then hit on the distal end of the horn 11. Since the horn 11 is in resonance with the ultrasonic of 65 KHz generated at the generators 10 and 10 each of which is supplied with 250V A.C., the resultant fuel is formed into thin film and then is atomized. The atomized liquid fuel can be supplied to a portion near the ignition plug in the combustion chamber in the engine, so that combustion can be established.

Obviously, numerous modifications and variations of the present invention are possible in light of the above teachings. It is therefore to be understood that within the scope of the appended claims, the invention may be practiced otherwise than as specifically described herein.

What is claimed is:

1. An injection device comprising:

a housing;

a first member accommodated in the housing and having an inner space which is terminated at one side thereof in a seat;

a second member having at one end thereof a head and disposed in the inner space of the first member in such a manner that an axial passage is defined therebetween and the head and the seat constitute a valve from which liquid fuel can be injected upon opening thereof;

an actuating means for opening and closing the valve; and a horn having an ultrasonic vibration generator for vibrating the horn and an atomizing portion extending adjacent the valve so that injected liquid fuel is atomized by the atomizing portion of the horn, wherein said first member is mounted to said housing at a first portion of the housing and said horn is rigidly mounted to said housing at a second portion of the housing which is farther from said first portion than said vibration generator is from said first portion.

2. An injection device according to claim 1, wherein the seat has a tapered configuration which opens away from the seat.

3. An injection device according to claim 1 wherein the actuating means includes a spring continually urging the second member in a direction for closing the valve and a pushing mean for moving the second member in a direction for opening the valve.

4. An injection device comprising:

a housing;

an elongate first member accommodated in the housing, the first member defining an inner space and having one end supported by a first portion of the housing and another end defining a seat;

an elongate second member fitted in said inner space, said second member having an upper end and a head end cooperating with said set to form a valve from which liquid fuel can be injected upon opening thereof; and a horn accommodated in the housing, the horn having an ultrasonic vibration generator positioned adjacent the one end of the first member and having an atomizing portion extending adjacent the valve so that the injected liquid fuel is atomized.

wherein said horn is rigidly mounted to said housing only at a second portion of the housing which is farther from said first portion than said vibration generator is from said first portion.

5. An injection device comprising:

a housing;

a first member accommodated in the housing and having an inner space which is terminated at one side thereof in a seat;

a second member having at one end thereof a head and disposed in the inner space of the first member in such a manner that an axial passage is defined therebetween and the head and the seat constitute a valve from which liquid fuel can be injected upon opening thereof;

an actuating means for opening and closing the valve; and a horn having an ultrasonic vibration generator for vibrating the horn and an atomizing portion extending adjacent the valve so that injected liquid fuel is atomized by the atomizing portion of the horn, wherein the first member is mounted on the horn via an O-ring and the is rigidly mounted to the housing at a node of resonance.

6. An injection device according to claim 5, wherein direct contacts between the first member and the horn is established only via the O-ring and the node of resonance in the horn.

* * * * *